US008182194B2

(12) United States Patent
Pruteanu et al.

(10) Patent No.: US 8,182,194 B2
(45) Date of Patent: May 22, 2012

(54) REFUSE VEHICLE PACKING SYSTEM

(75) Inventors: Claudiu D. Pruteanu, Kasson, MN (US); Jarud H. Hoefker, Dodge Center, MN (US); Timothy J. Edelbach, Hayfield, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 910 days.

(21) Appl. No.: 12/142,036

(22) Filed: Jun. 19, 2008

(65) Prior Publication Data

US 2009/0317219 A1 Dec. 24, 2009

(51) Int. Cl.
*B65F 3/00* (2006.01)

(52) U.S. Cl. ..... 414/510

(58) Field of Classification Search ..... 414/510, 414/407–409, 514, 516, 520, 525.1, 525.2, 414/525.4

See application file for complete search history.

(56) References Cited

U.S. PATENT DOCUMENTS

| | | | | |
|---|---|---|---|---|
| 4,162,735 | A * | 7/1979 | Lewis | 414/514 |
| 5,314,290 | A * | 5/1994 | Lutz et al. | 414/509 |
| 5,651,654 | A | 7/1997 | Christenson | |
| 5,769,592 | A | 6/1998 | Christenson | |
| 5,931,628 | A | 8/1999 | Christenson | |
| 7,086,818 | B2 * | 8/2006 | Pruteanu et al. | 414/406 |
| 7,563,066 | B2 * | 7/2009 | Jones et al. | 414/525.2 |

* cited by examiner

*Primary Examiner* — Joshua Rudawitz
(74) *Attorney, Agent, or Firm* — Nikolai & Mersereau, P.A.; C. G. Mersereau

(57) ABSTRACT

The present disclosure is directed to a refuse collection vehicle including a vehicle body for receiving, compacting, transporting and ejecting refuse materials of a type using a packer panel that operates reciprocally along in said vehicle body with a connected follower panel in which the receiving and packing arrangement enables refuse to be deposited into a receiving section or area at any time regardless of the reciprocal position of the packer panel and which includes an efficient, low maintenance wiper member design in conjunction with a follower panel attached to the packer panel such that the top surface of both the follower panel and the packer panel are cleaned or swept off during the return or retraction stroke of the packer panel.

15 Claims, 9 Drawing Sheets

REFUSE VEHICLE PACKING SYSTEM

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to refuse collecting vehicles and, particularly, to any, rear-discharging refuse vehicle having a packing panel system which utilizes a follower panel and a wiper member such that it can accommodate deposition of refuse with the system in any position of a packing cycle. The packing system, which includes a packing panel with connected follower, is provided with a long-wearing, abrasion-resistant wiper blade fixed in position to engage the top surface of the packer panel so that retraction of the follower/packer panel causes the wiper blade to sweep off any deposited refuse material. Particular applications include front and side loading vehicles.

II. Related Art

Refuse hauling vehicles commonly include a heavy-duty chassis including a forward cab and a separately manufactured truck body mounted on the chassis and dedicated to receiving, compacting, hauling and discharging refuse materials. The truck body which attaches to the chassis generally includes all the associated hydraulic, pneumatic and/or electrical operating mechanisms associated with heavy-duty packing and ejection equipment. In front or side-loading systems, a charging or receiving hopper or section is provided behind the cab and forward of the storage volume to accept deposited refuse. The receiving section further contains a packing system for packing deposited refuse rearward into a storage enclosure. As indicated, the receiving area or section is located behind the truck cab and refuse to be hauled is loaded into the receiving area as by tipping containers, either manually, with a cart tipper or other mechanized container handling system which, in the case of a side-loading vehicle, is mounted on one side of the charging hopper or to the truck chassis. Thus, loading of the charging area is accomplished through side openings or an open top. The packing system includes a reciprocating or sometimes rotating ram, usually hydraulically operated, which compacts the material moving it rearward into the storage compartment where it is eventually compacted against a heavy-duty tailgate, normally in the shape of a pressure vessel.

It is known to provide a front, rear or side-loading refuse vehicle body with a packing and ejecting mechanism that packs refuse from a charging area or section into an associated hollow storage enclosure. The body is usually designed to be tipped to fully eject the refuse from the storage enclosure, but it may have an ejector design that enables it to fully eject refuse without tipping. In front loading vehicles, it is known to provide frontal forks or a mechanized lifting and emptying apparatus situated on one side of the receiving hopper such that a container of interest may be engaged and emptied into the receiving hopper. A side-loading apparatus typically includes a holding or grasping device generally connected to an arm or extensible boom which is connected, in turn, to a base mounted on the vehicle. The arm or boom and grasping device are operated in concert to engage a container of interest, lift and dump the container into the receiving hopper in the vehicle. Such systems are typically operated using one or more hydraulic devices to extend or retract the boom, pivot the arm and open and close the grabbing device. Examples of such booms are shown in U.S. Pat. Nos. 5,657,654; 5,769,592; and 5,931,628.

Side loading refuse collection truck bodies may be manually loaded, have cart tipper or automatic loading devices, or combine or accommodate both manual and automated-type container loading abilities. Packer panel systems have also been provided with connected follower members that enable the loading of refuse to proceed with the packer panel in any position, including a fully extended packing position. While all of these types of systems have also been provided with wiper devices to remove material deposited on the top of the packer panel and follower, known wiper devices have been subject to early deterioration and have required frequent replacement, thus, there remains a need for a packer panel system including a wiper system that produces more efficient material removal and longer wiper life.

SUMMARY OF THE INVENTION

The present development pertains to any refuse collection vehicle of a type using a packer panel that operates reciprocally along in the vehicle body with a connected follower panel in which the receiving and packing arrangement enables refuse to be deposited into a receiving section or area at any time regardless of the position of the packer panel. The development provides an efficient, low maintenance wiper system, including a wiper member design in conjunction with a follower panel attached to the packer panel such that the top surface of both the follower panel and the packer panel are cleaned, i.e., deposited material is swept off during the return or retraction stroke of the packer panel. The new wiper has a much longer, useful life and exhibits more efficient refuse material removal characteristics.

In accordance with one preferred embodiment, the wiper assembly includes an elongate wiper blade member that addresses the surface to be cleaned with a beveled edge. A hollow wiper mounting member is provided having a front surface disposed to receive the wiper blade at the proper angle to address the surfaces to be wiped, a wiper guard member is designed to overlay the wiper blade member and a plurality of spaced threaded connector members connect the wiper guard member to the wiper mount through aligned corresponding openings in the wiper blade member thereby capturing the wiper blade member therebetween. The openings in the wiper blade member are slotted to allow adjustment of the height of the downward directed beveled edge. The wiper blade member can be provided with bevels on both edges so that it can be reversed and a second edge exposed when a first edge becomes worn. Presenting a beveled edge has been found to provide better efficiency in material removal.

The wiper blade member itself is preferably made of a material that has a rather low friction coefficient, is abrasion resistant and is substantially inert to the many corrosive constituents of the refuse environment. One such preferred material is a composite polyurethane material which may be fiber reinforced and/or which may be used to cover a solid core, such as a metallic core. While polyurethane may be a preferred material, other materials which meet the necessary qualifications may also be used. These include, for example, high density polyethylene or polypropylene and polyamide materials.

The wiper member is designed to operate in conjunction with a packer panel and connected followers such that the wiper cleans the refuse off the packer and follower during a retraction stroke of the packer panel so that any material deposited in the area of the receiving hopper is swept off the upper surfaces and deposited in front of the packer panel.

In accordance with one embodiment, and by way of example, the system is shown on a manual/automated side-loading refuse collection vehicle body for receiving, compacting (packing), transporting and ejecting refuse materials a front loading refuse body is also shown.

BRIEF DESCRIPTION OF THE DRAWINGS

In the drawings wherein like reference characters denote like parts throughout the same.

DETAILED DESCRIPTION

The detailed description features embodiments in the form of a manual/automated side-loading, or front-loading rear-discharging refuse collection vehicle. These embodiments are meant as examples only and are not intended to limit the scope of the inventive concepts in any manner.

The front or side-loading refuse collection vehicle bodies include a refuse packing system having a low profile packer panel designed to operate reciprocally along the vehicle body charging area to push deposited refuse rearward and include a packer panel and hinged follower panel and a unique long-life wiper system that cleans deposited refuse from the upper surface of the follower panel and packer panel in an efficient manner that enables deposit of refuse with the packer panel in any state of packing or retraction.

Figure 1:
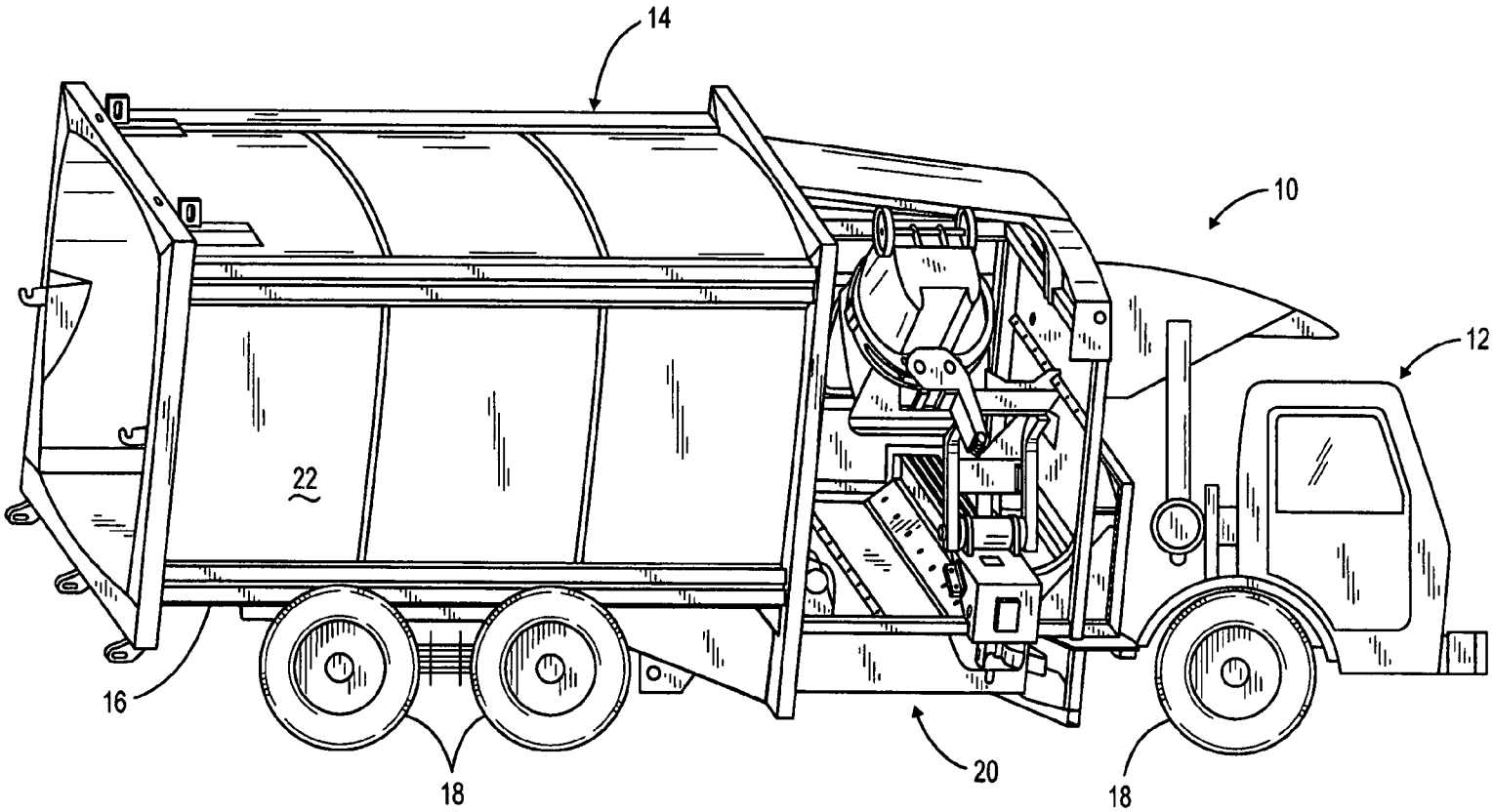
FIG. 1 is a schematic perspective view of a refuse hauling vehicle with a manual/automated side-loading, rear-discharging packer body including the packing system of the present invention, shown with tailgate removed.

In FIG. 1, there is shown a schematic perspective view of a refuse hauling vehicle, generally at 10, which includes a chassis-mounted cab 12 and a dedicated refuse processing body 14 shown with the tailgate removed. The packer body is mounted on heavy chassis members as at 16 and is carried by a plurality of wheels as at 18. The truck body basically includes a charging or receiving area indicated generally by 20 and a relatively large storage area at 22. In the view illustrated in FIG. 1, the tailgate has been removed showing a portion of the interior of the storage volume 22.

As seen best in FIGS. 2-5, the packing system includes a packer panel 30 with attached follower 32 hinged to the packer panel by a hinge 34. The wiper system is shown at 36 and includes a hollow shaped wiper mounting member 38 fixed to a support member 40, wiper blade member 42 and a wiper guard member 44. Spaced threaded fastening devices are shown at 46. A roller device 48 (FIGS. 4 and 5) is attached to the end of the follower panel to engage the front wall of the truck body and guide the panel in its upward pivoting path as the packer panel is retracted. The packer panel is supported by and travels on a pair of spaced packer rider members (bars or tubes) 50 which include top, bottom and side wear surfaces (plates or strips) as at 52 and which ride in a rail system on each side of the packer body (not shown).

Figure 2:
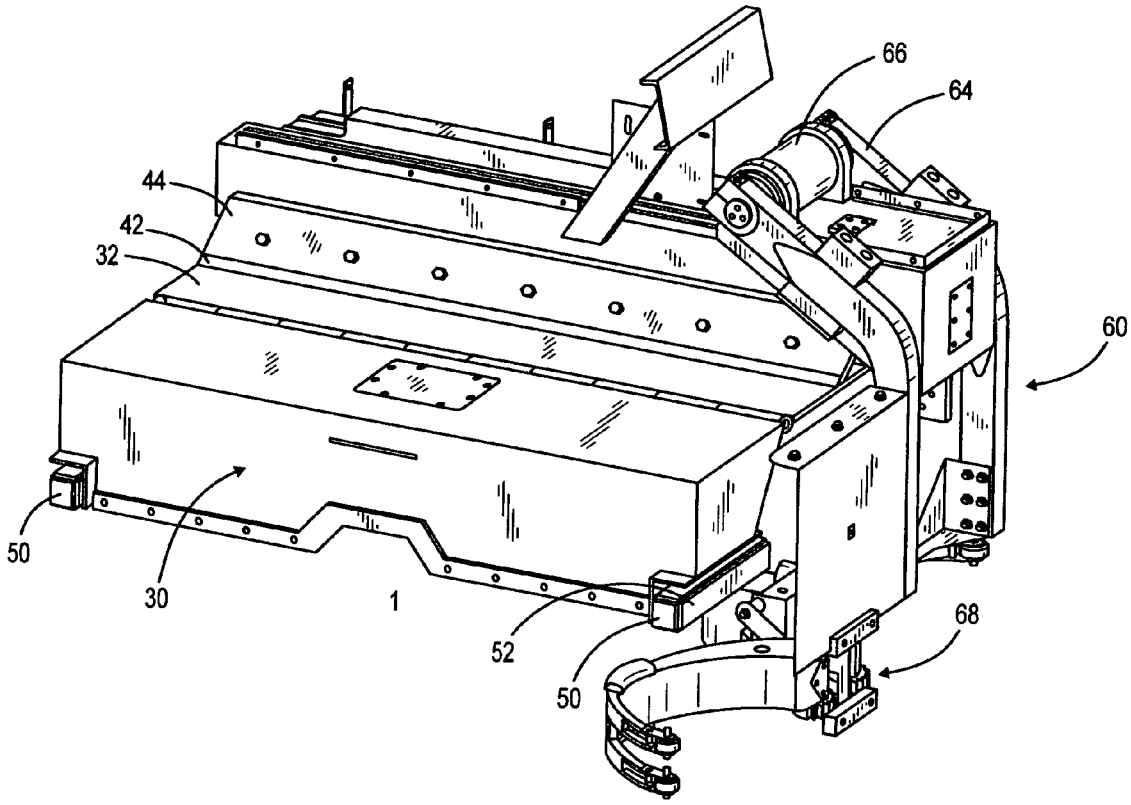
FIG. 2 is a fragmentary schematic perspective view of a packer arrangement with a container handling device with one style of grabber and incorporating a wiper blade in accordance with the invention shown with the container handling device fully stowed and the packer panel fully extended in the packing position.

The side-loading system further includes a container handling apparatus 60 (shown in FIG. 3) with a container 62 in a fully elevated or tipped position. In FIG. 2, the system is shown in a lowered fully stowed position. The system includes a pair of lift arms as at 64 operated by a double-ended rotary actuator 66 and includes a container grabber assembly as shown at 68 in FIG. 2. A slightly different style of grabber is shown at 69 in FIG. 3. The container grabber assembly may be mounted in an offset position as shown and many types of such devices are available.

Figure 3:
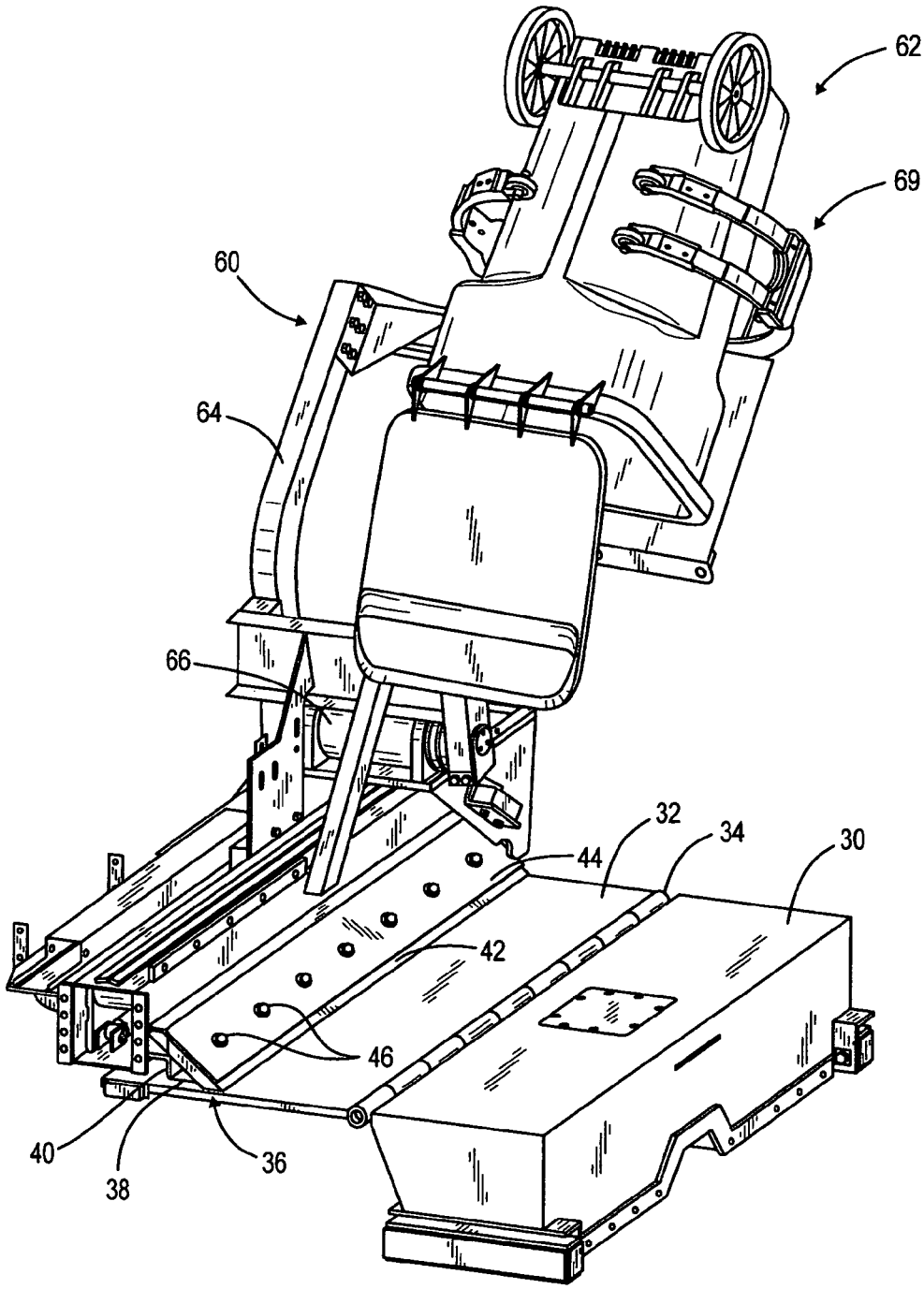
FIG. 3 is a fragmentary schematic perspective view of the arrangement of FIG. 2 taken from the opposite side and showing an alternate style of grabber with a cart in a fully tipped position.
Figure 4:
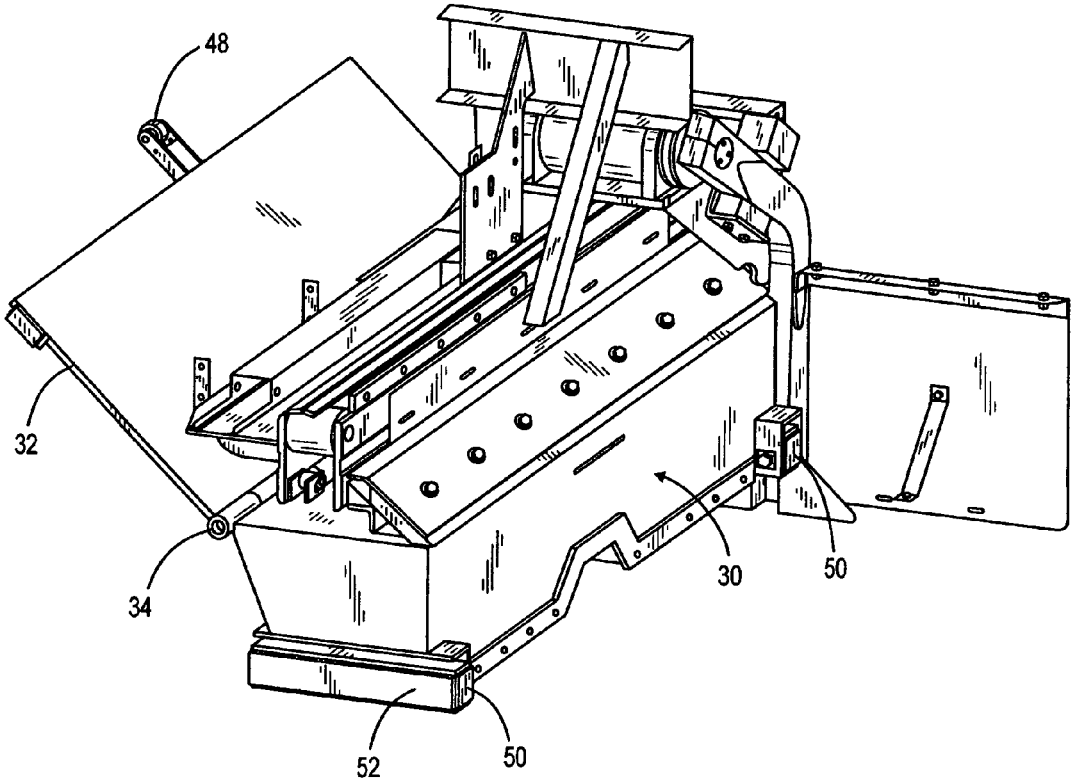
FIG. 4 is a fragmentary schematic perspective view similar to FIG. 3 with the container handling device stowed and the packer panel fully retracted.
Figure 5:
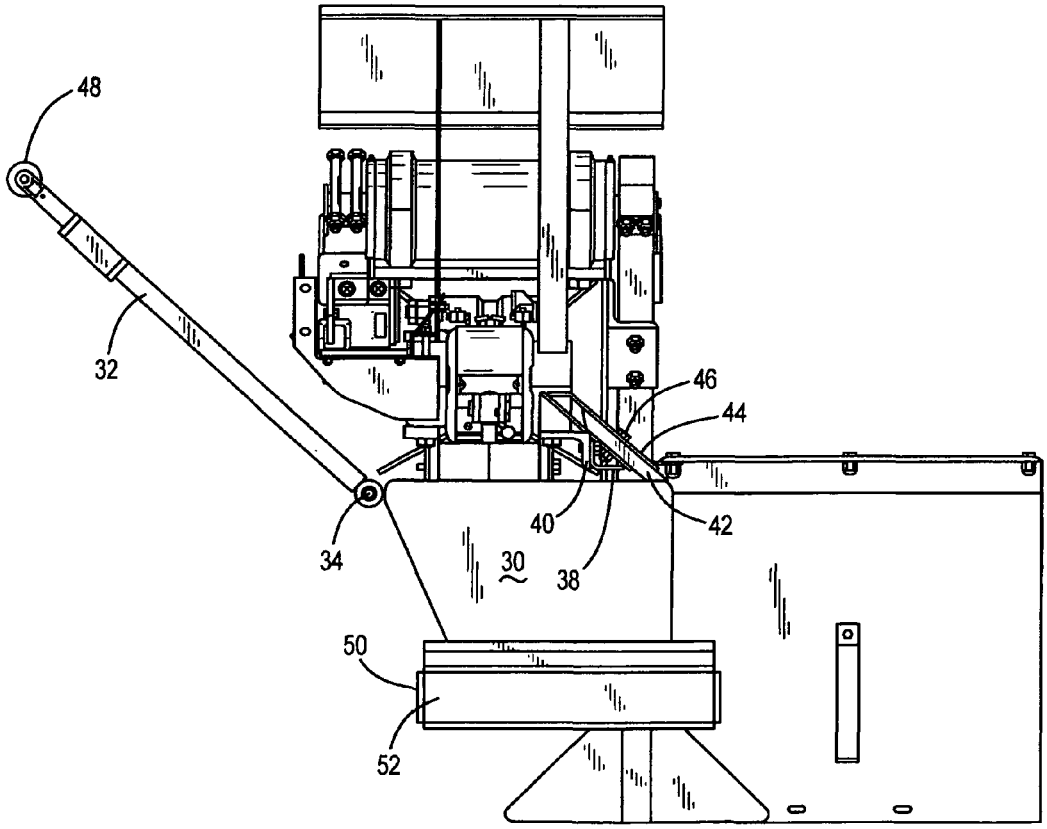
FIG. 5 is a side elevational view of the arrangement shown in FIG. 4.

FIGS. 2 and 3 depict the packer panel situated in a fully extended or packing position and FIGS. 4 and 5 show the system with the packer panel fully retracted. The wiper member 42 and associated hardware span the entire width of the packer panel 30 and follower 32 so that any material left on top is cleaned off by the wiper blade member 42 as the packer panel retracts. In the fully retracted position, the wiper blade 42 is situated at or near the outer end of the packer panel as shown in FIG. 4.

Figure 6:
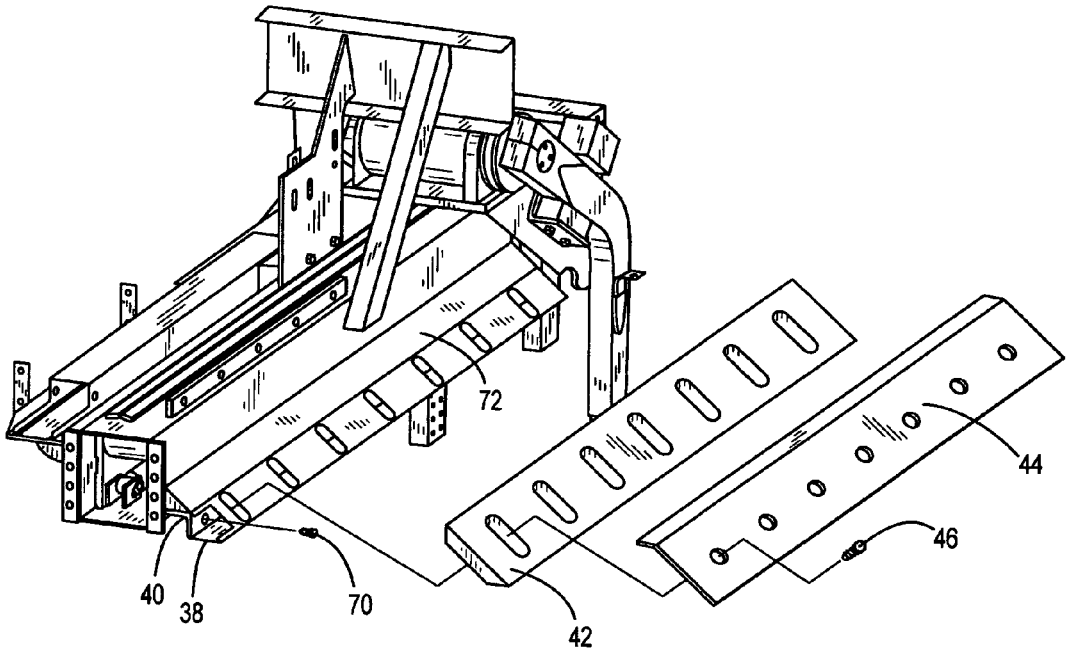
FIG. 6 is a fragmentary view of the arrangement of FIG. 4 with the packer panel and follower removed and the wiper blade assembly in accordance with the invention shown blown apart.
Figure 7:
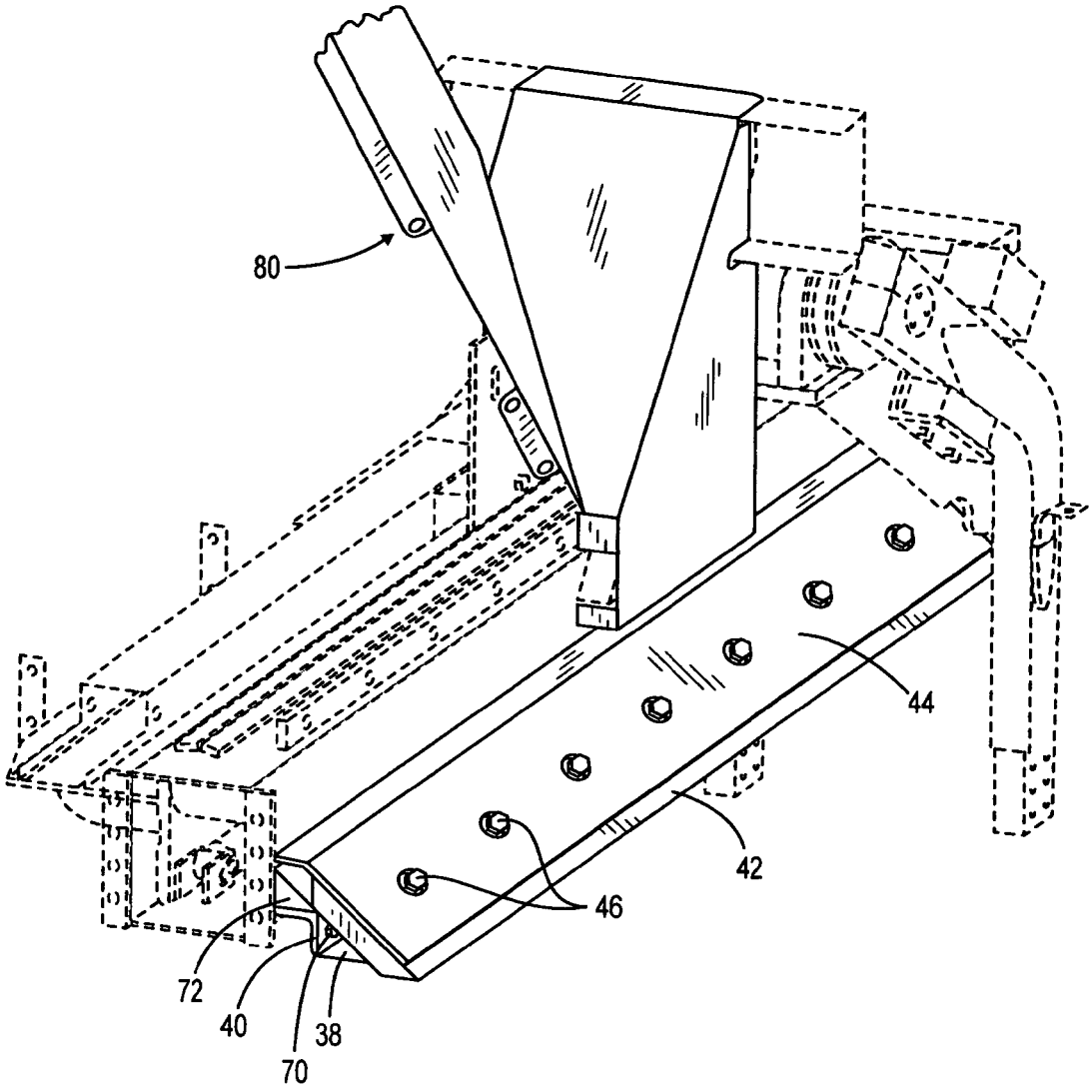
FIG. 7 is a view similar to FIG. 6 slightly enlarged and showing the wiper blade assembly secured in position and a cover weldment above the packer in place.

As shown in FIGS. 6 and 7, the mounting member 38 is secured to support member 40 as by threaded fastener 70. Additional support is afforded by a further angled member 72 and the upper portion of the wiper blade 42 is covered by the wiper guard member 44. Note that the openings in the wiper blade member are elongated or slotted to accommodate height adjustment as needed for the wiper blade member.

In FIG. 7, the wiper system is shown fully assembled with a cover weldment 80 in place. The bottom beveled edge of the wiper blade member, as assembled on the support members above the packer panel and follower, is generally horizontally disposed.

Figure 8:
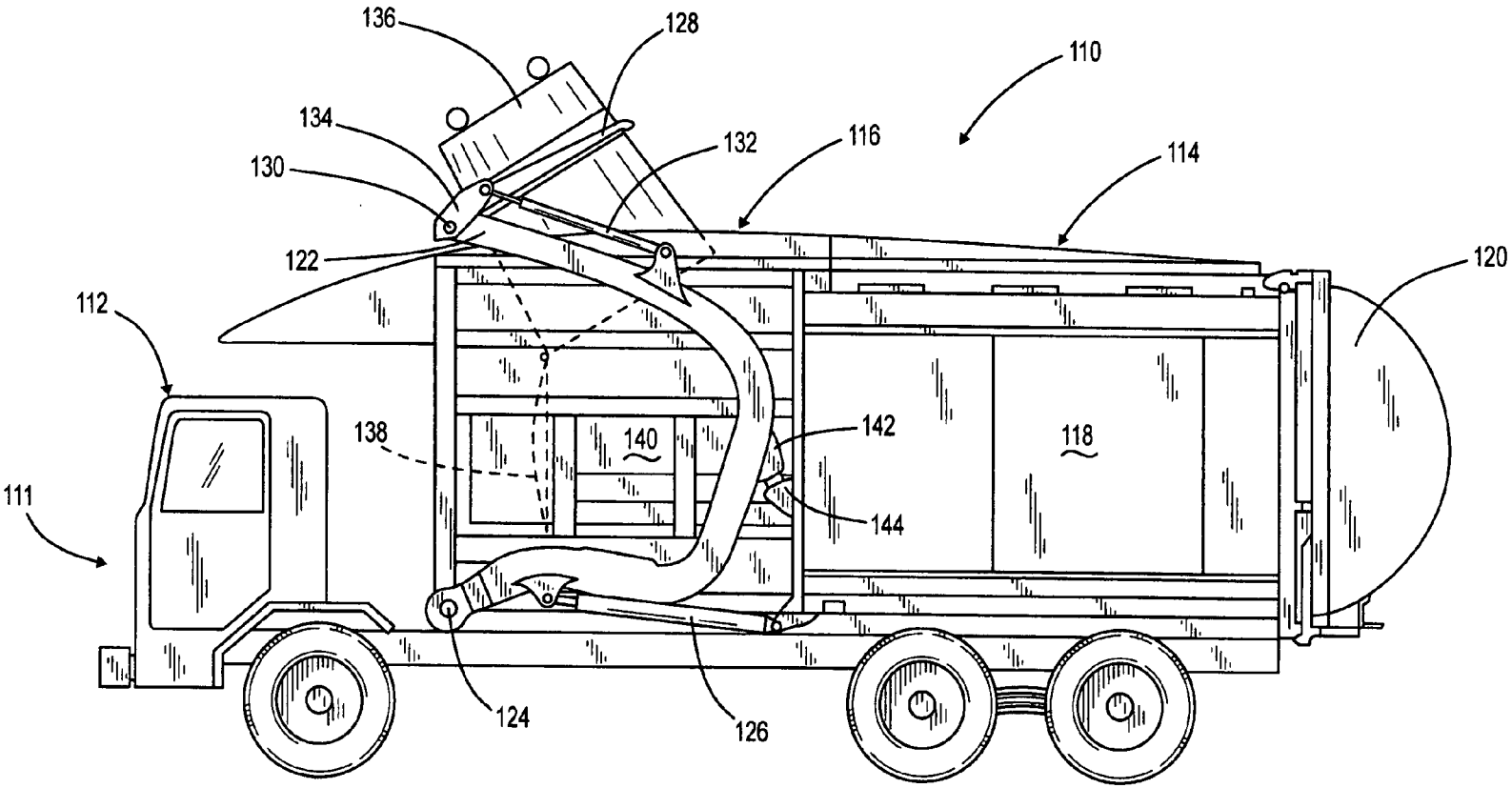
FIG. 8 is a schematic side elevational view of a refuse hauling vehicle with a front loading, rear discharging packing body suitable for including the packing system of the present invention.

FIG. 8 depicts a schematic side view of a front-loading refuse hauling vehicle, generally 110, including a truck chassis 111, which carries a cab 112 which houses the controls for the vehicle and operator. A refuse collecting body 114 is also carried by the chassis 111 and includes a refuse receiving or charging hopper 116 having an opening for receiving refuse dumped into the charging hopper 116. A refuse storage volume is shown at 118 together with a tailgate 120 against which refuse is packed and which is opened for discharging the packed material. The vehicle includes a front-end loading mechanism having a pair of lift arms one of which is shown at 122 and which are pivotally mounted to the vehicle on heavy bearing as at 124.

Fluid cylinders, one of which is shown at 126 are utilized to operate the arms, pivot them about pivot points as shown at 124. As illustrated in FIG. 8, the arm are shown in the fully raised position. A pair of forks, one of which is shown at 128 are pivotally attached to rotate at the ends of the lift arms 122 as pivot joints 130 utilizing double acting cylinders, one of which is shown at 132 with connected lever arms as at 134. A collection container 136 is illustrated in the fully tipped or inverted position with its open top 138 shown well inside the charging hopper volume 140 of the truck body 114. Arm rests are provided for the fully raised arms in the form of brackets as at 142 and 144. Attached respectively to the arms and truck body and cushioning rubber bumper attached to the truck body bracket.

Figure 9:
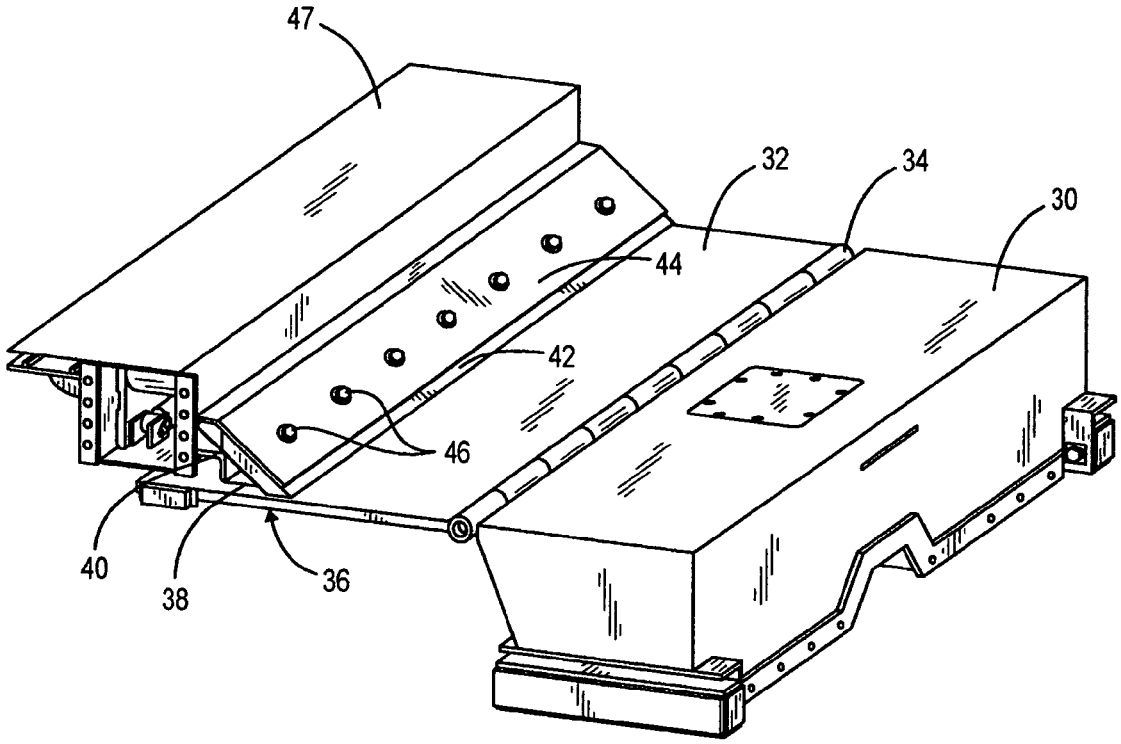
FIG. 9 shows a packing system suitable for use in the packer and body of FIG. 8.

A low profile packer panel system is shown in FIG. 9 that is configured to be mounted inside the charging hopper area 116 of the truck body 114. The packing system of FIG. 9 may be substantially similar to the system illustrated in FIGS. 2-5 except that it needs no provision for accommodating a side-loading container handler. It includes a top panel 47. It should be noted, however, that it may be possible to combine side and front loading attributes in a single embodiment in which the packing system shown in FIGS. 2-5 or a similar system may be used in combination with a front loading refuse collection body.

As indicated previously, the blade wiper member itself is preferably made of a material that combines a rather low friction coefficient with abrasion resistance and is one that is substantially chemically inert to materials and liquids likely to be contained in refuse to be processed. It is desirable that the wiper blade member have a long useful life in what is a very hostile environment. In this regard, certain available composite polyurethane materials which, if desired, can be fiber reinforced and have been found to be quite successful in this application. This wear surface can be used as a coating over other material such as a metallic core or the wiper blade member may be made entirely of the same material. While success has been achieved with polyurethane materials, it is contemplated that other polymer materials such as high density polyethylene or polypropylene may also be used.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A rear-discharging refuse collection vehicle including a vehicle body comprising:

(a) a charging area for receiving refuse to be collected;

(b) a refuse storage volume rearward of said charging area;

(c) a refuse receiving and packing arrangement further including:

(1) a packing system including a packer panel operable along and in said charging area for urging refuse material received in said charging area into said storage volume, said packing system further including a follower panel pivotally attached to a rear portion of and extending behind said packing panel and which moves with said packer panel for preventing refuse from being deposited behind said packer panel when said packer panel is extended forward toward said storage volume, said follower panel further comprising a roller device for engaging a wall of said vehicle body;

(2) an independent wiper assembly mounted in said charging area and including a wiper blade member positioned with a lower surface mounted adjacent to the upper surface of said packer panel and said follower panel, as extended, said wiper blade member being disposed so that said lower surface of said wiper blade wipes material from both said follower panel and said packer panel as said follower panel and said packer panel move beneath said wiper blade when said packer panel is retracted from an extended position to a retracted position and wherein said wiper member comprises a relatively inert, abrasion-resistant polymer material.

2. A refuse collection vehicle as in claim 1 wherein said wiper member includes a polyurethane material.

3. A refuse collection vehicle as in claim 1 wherein the lower surface of said wiper member is beveled.

4. A refuse collection vehicle as in claim 1 wherein the height of said wiper member is adjustable.

5. A refuse collection vehicle as in claim 1 wherein said wiper blade member extends across the width of said packer panel and said follower panel.

6. A refuse collection vehicle as in claim 1 wherein said follower panel is hinged to said packer panel.

7. A refuse collection vehicle as in claim 1 wherein said wiper blade member is reversible.

8. A refuse collection vehicle as in claim 1 wherein said vehicle is a front-loading vehicle.

9. A refuse collection vehicle as in claim 1 wherein said vehicle is a side-loading vehicle.

10. A refuse collection vehicle as in claim 8 further comprising a container handling apparatus for accessing and emptying containers.

11. A wiper assembly designed to be mounted independent of, but with reference to a packer panel having a follower attached to a rear portion and extending behind said packing panel in a charging area of a front or side-loading refuse vehicle body, said follower panel further comprising a roller device for engaging a wall of said vehicle body, said wiper assembly including a wiper blade member having a lower surface configured to be mounted to address the top surface of both said packer panel and said follower panel, as extended, said wiper blade member being disposed so that said lower surface wipes material from said follower panel and said packer panel as said packer panel is retracted from an extended position to a retracted position and wherein said wiper member comprises a relatively inert, abrasion-resistant polymer material.

12. A wiper assembly as in claim 11 wherein said wiper member includes a polyurethane material.

13. A wiper assembly as in claim 11 wherein the lower surface of said wiper member is beveled.

14. A refuse collection vehicle as in claim 11 wherein the height of said wiper member is adjustable.

15. A refuse collection vehicle as in claim 11 wherein said wiper blade member is reversible.

* * * * *